US010173756B2

(12) United States Patent
Little

(10) Patent No.: US 10,173,756 B2
(45) Date of Patent: Jan. 8, 2019

(54) CONFIGURABLE WATER ACTIVITY BOARD

(71) Applicant: Best Foot Forward Thinking, LLC, Aptos, CA (US)

(72) Inventor: Jessica Burns Little, Aptos, CA (US)

(73) Assignee: BEST FOOT FORWARD THINKING, LLC, Aptos, CA (US)

( * ) Notice: Subject to any disclaimer, the term of this patent is extended or adjusted under 35 U.S.C. 154(b) by 0 days.

(21) Appl. No.: 15/614,311

(22) Filed: Jun. 5, 2017

(65) Prior Publication Data

US 2017/0355428 A1 Dec. 14, 2017

Related U.S. Application Data

(60) Provisional application No. 62/349,454, filed on Jun. 13, 2016.

(51) Int. Cl.

| | |
|---|---|
| ***B63B 35/79*** | (2006.01) |
| ***B63B 35/85*** | (2006.01) |
| ***A63B 26/00*** | (2006.01) |
| ***A63B 35/02*** | (2006.01) |
| *A63B 69/00* | (2006.01) |
| *A63B 71/06* | (2006.01) |

(52) U.S. Cl.

CPC ..... *B63B 35/7906* (2013.01); *A63B 26/003* (2013.01); *A63B 35/02* (2013.01); *B63B 35/7909* (2013.01); *B63B 35/85* (2013.01); *A63B 69/0064* (2013.01); *A63B 2071/0694* (2013.01); *A63B 2225/605* (2013.01); *A63B 2225/682* (2013.01); *A63B 2225/685* (2013.01); *B63B 2709/00* (2013.01)

(58) Field of Classification Search

CPC .. B63B 35/7906; B63B 35/85; B63B 35/7909
See application file for complete search history.

(56) References Cited

U.S. PATENT DOCUMENTS

| | | | | |
|---|---|---|---|---|
| 5,127,862 | A * | 7/1992 | Pia | B63B 35/7906 114/39.14 |
| 9,643,696 | B1 * | 5/2017 | Lockhart | B63B 35/85 |
| 2012/0015334 | A1 * | 1/2012 | Hamilton | A63B 71/0622 434/247 |
| 2012/0077396 | A1 * | 3/2012 | Lipman | B63B 35/71 441/74 |

* cited by examiner

*Primary Examiner* — Stephen P Avila
(74) *Attorney, Agent, or Firm* — TechLaw LLP; Sam K. Tahmassebi

(57) ABSTRACT

Embodiments of water activity board 10 that may be configured with several components 210A-H to form a WABS 200, where the components 210A-H may be securely and removably coupled to the board 10 via one or more rail modules 100A-I. Other embodiments may be described and claimed.

19 Claims, 13 Drawing Sheets

200A

200A

200C

100I

100I

210E

210E

210E

CONFIGURABLE WATER ACTIVITY BOARD

TECHNICAL FIELD

Various embodiments described herein relate to water activity boards employed for exercise or relaxation.

BACKGROUND INFORMATION

It may be desirable to provide a configurable water activity board system to enable users of various skill and physical capabilities to use the board for exercise or relaxation, the present invention is such a configurable water activity board.

DETAILED DESCRIPTION

The present invention includes a configurable water activity board 10 that may be configured with components to form many different water activity board systems (WABS) 200 that may be employed by users of various skill and physical capabilities for exercise or relaxation. In an embodiment, a water activity board 10 may be configured with several components 210A-H to form a WABS 200 that may enable a user to employ a paddle (212I FIG. 3D) to control the WABS from a standing, kneeling, or seated position. The WABS 200 length, width, shape, and buoyancy may be selected to enable users of various weight and physical capabilities to use the WABS 200 in open water including rivers, lakes, ponds, bays, reservoirs, oceans, and other man-made or natural open water locations. The WABS 200 may also be used in closed water locations and dry land.

Figure 1A:
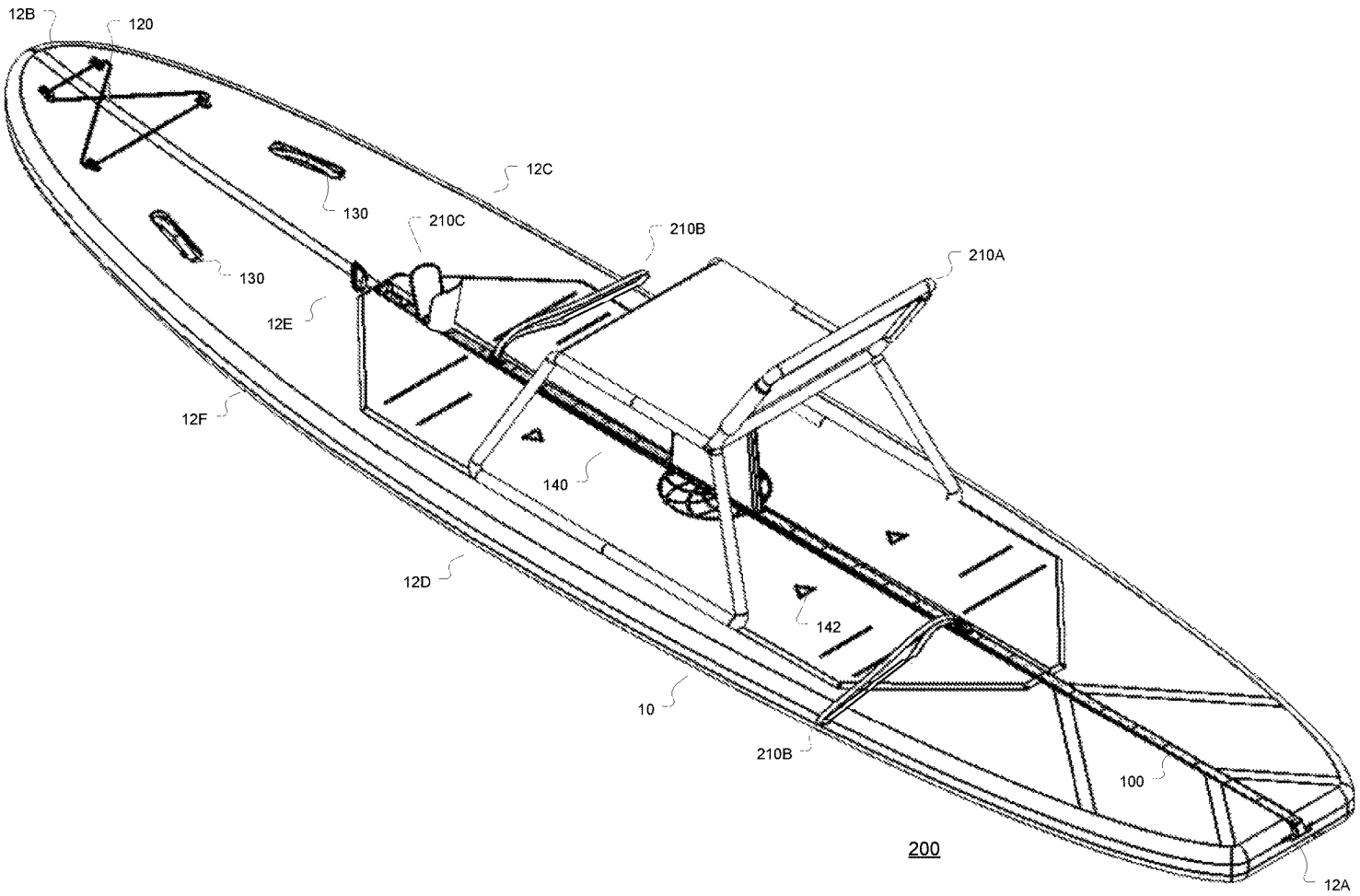
FIG. 1A is an isometric diagram of a configurable water activity board configured with several components according to various embodiments.
Figure 1B:
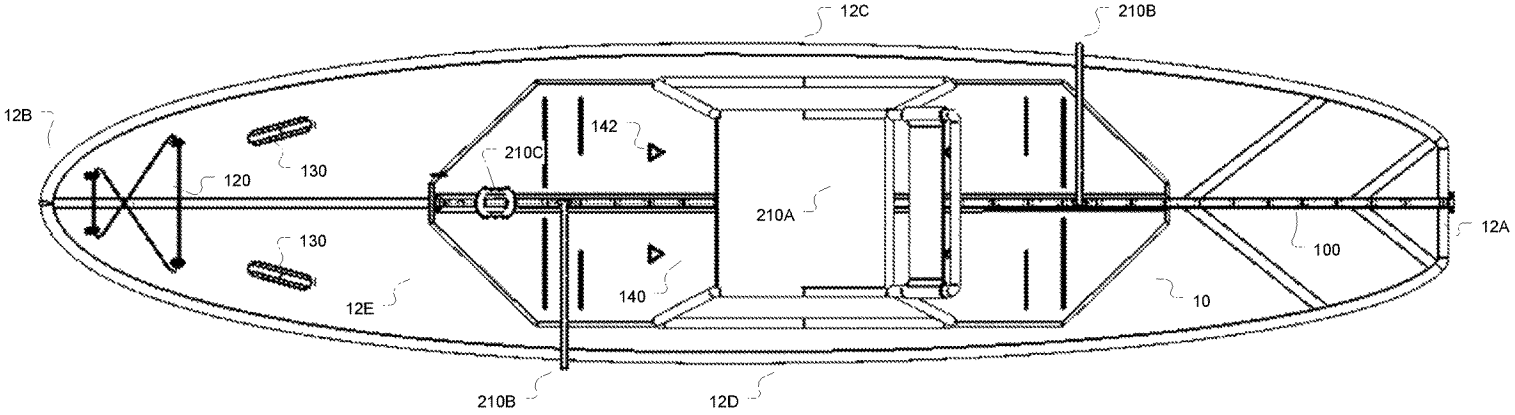
FIG. 1B is a top diagram of a configurable water activity board configured with several components according to various embodiments.
Figure 1C:
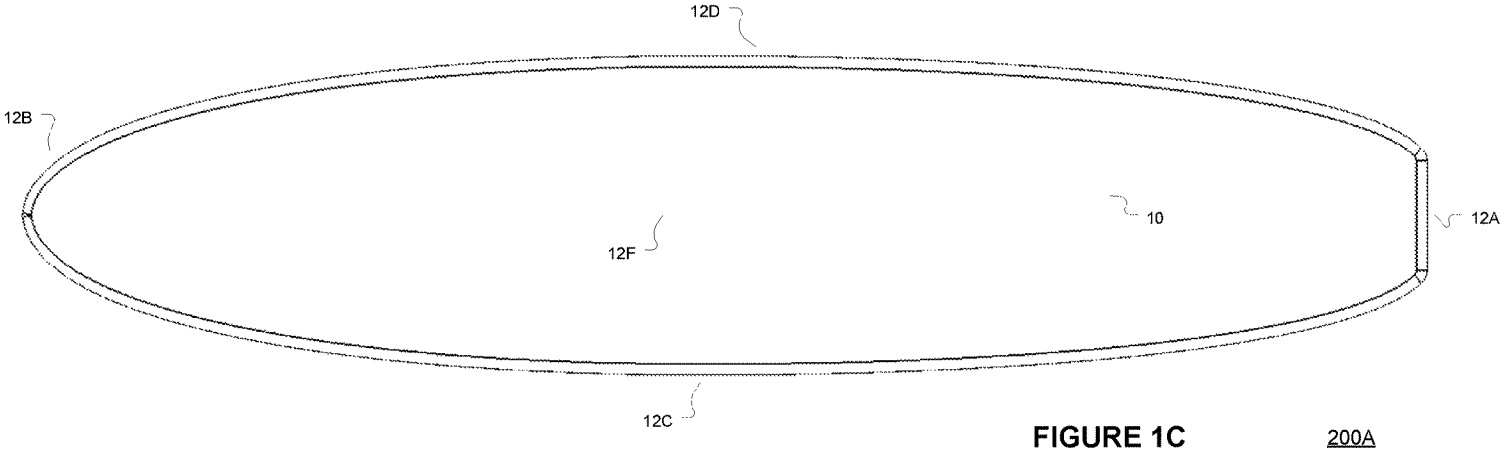
FIG. 1C is a bottom diagram of a configurable water activity board configured with several components according to various embodiments.
Figure 1D:
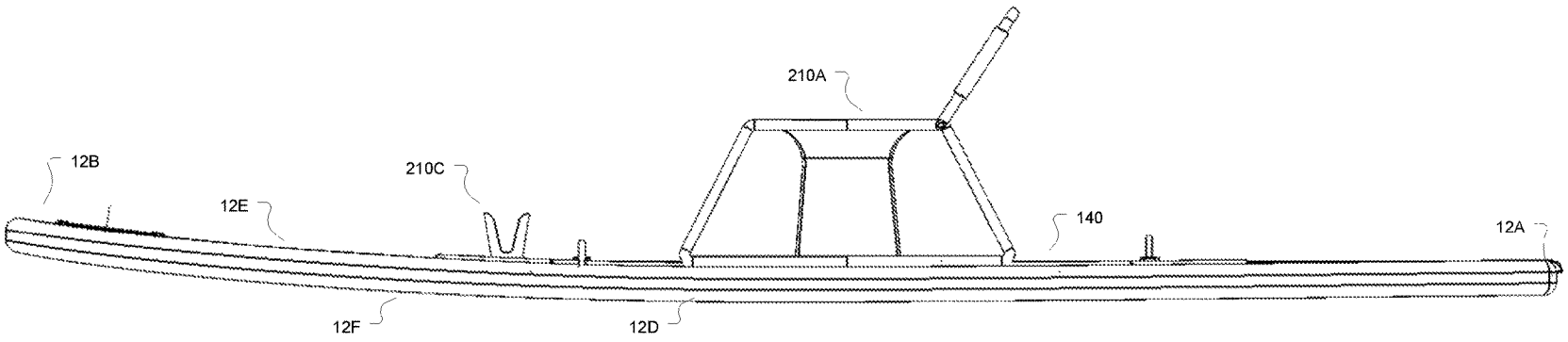
FIG. 1D is a left side diagram of a configurable water activity board configured with several components according to various embodiments.
Figure 1E:
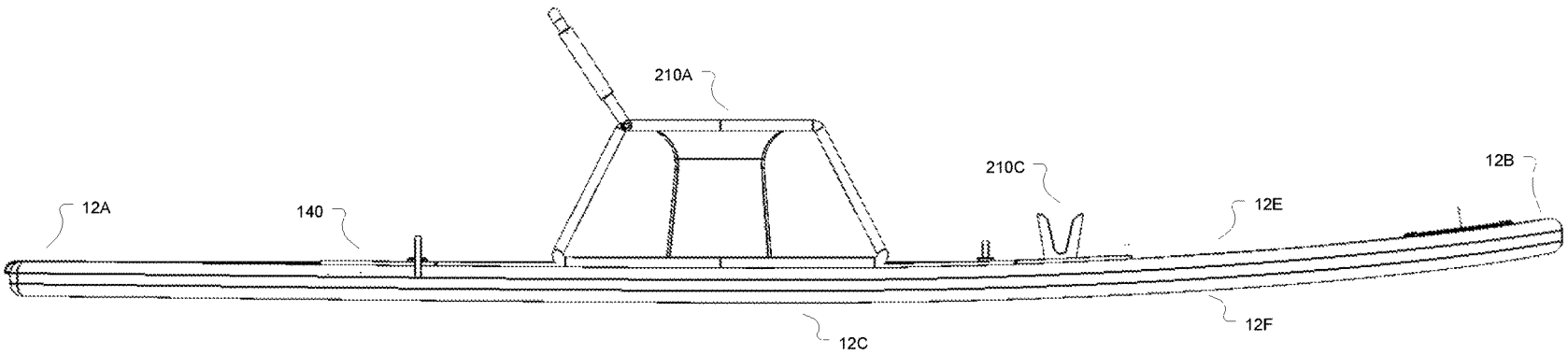
FIG. 1E is a right side diagram of a configurable water activity board configured with several components according to various embodiments.

FIG. 1A is an isometric diagram, FIG. 1B is a top diagram, FIG. 1C is a bottom diagram, FIG. 1D is a left side diagram, and FIG. 1E is a right side diagram of a WABS 200 including a configurable water activity board 10 configured with several components 210A, 210B, and 210C according to various embodiments. As shown in FIGS. 1A-1E, the configurable water activity board (CWAB) 10 may include a tail or rear 12A, a front 12B, a right side or rail 12C, a left side or rail 12D, a top or deck 12E, and a bottom 12F. In an embodiment, the CWAB 10 front 12B top or deck 12E may include bungee cords coupled to the top 12E at several points and recessed, deployable handles 130.

The CWAB 10 top or deck 12E may also include large compressible pad(s) 140 extending centrally from the CWAB 10 top 12E towards the front 12B and tail or rear 12A. The pad 140 may be formed from a compressible, foot relief material including a polymer, neoprene, nitrile rubber, EDPM rubber, natural rubber, or other compressible material that reduces contact stress. The pad 140 may also include a top woven material non-slip layer that provides traction even when wet. The pad 140 top may have one or more markings 142 related to water activities or exercise activities including yoga positions/movements. The pad 140 may cover 10 to 100% or about 40 to 80% in embodiment of the deck's 12E surface area in an embodiment.

Figure 3A:
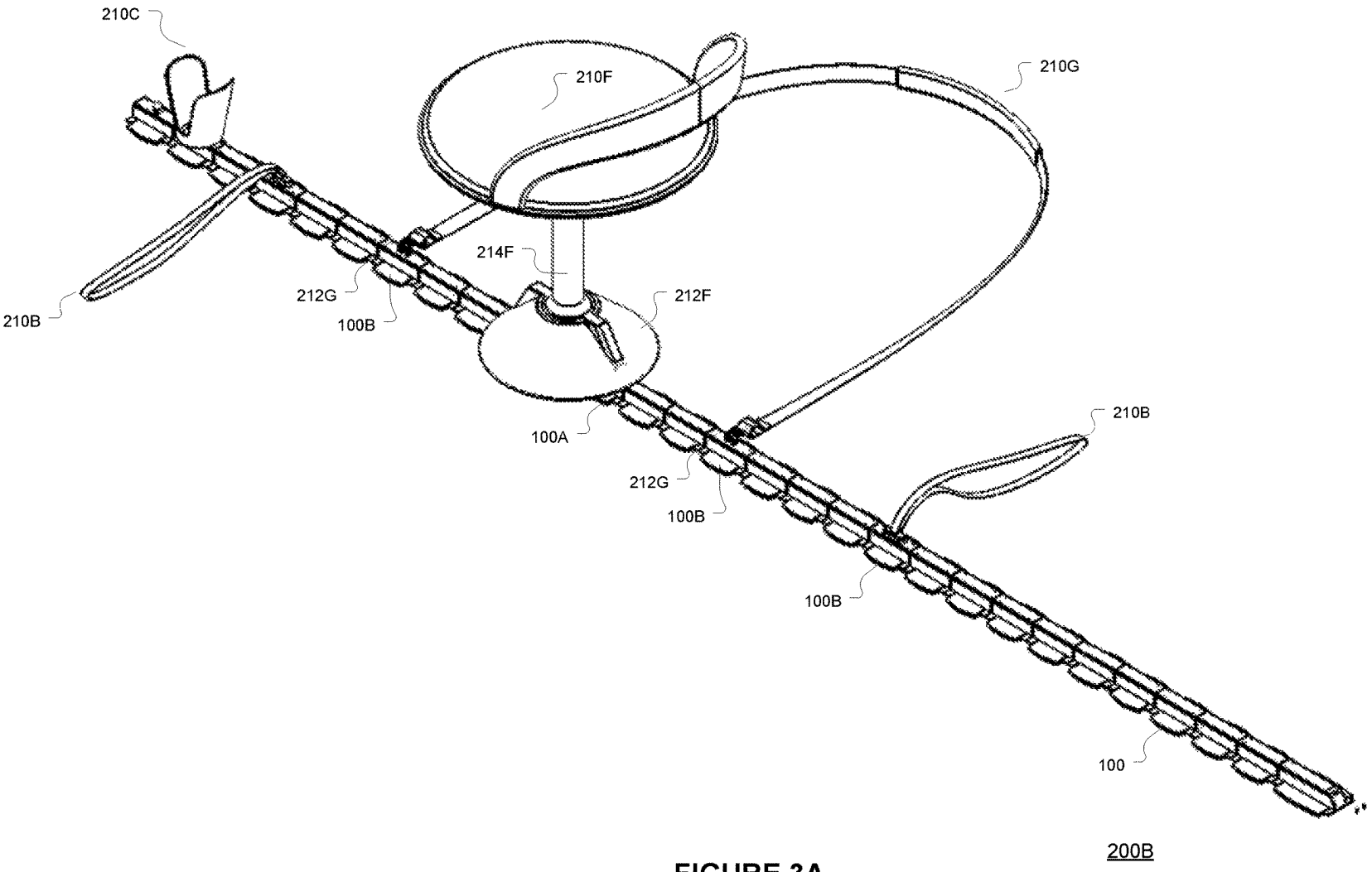
FIG. 3A is an exploded isometric view of a configurable water activity board segment that may be formed with the configurable water activity board segment shown in FIG. 2A to form another configurable water activity board according to various embodiments.
Figure 3D:
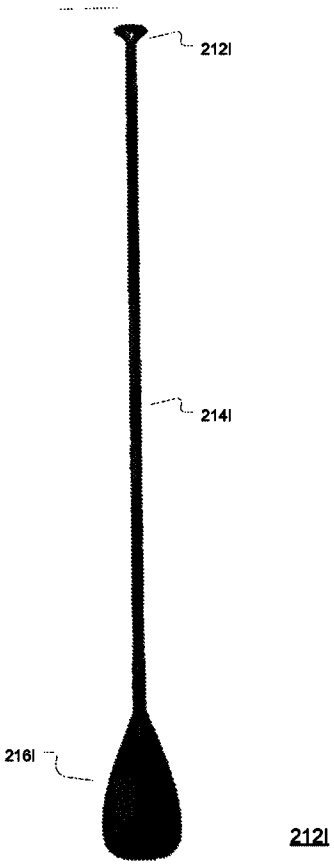
FIG. 3D is a view of a paddle according to various embodiments.

The CWAB 10 may have an overall length (from tail or rear 12A to front, nose, or bow 12B) of about 7 to 21 feet as a function of the user's size and the application and about 12 to 13 feet in an embodiment. For younger or smaller users, the overall length may be less than 9 feet. For quick surf applications, the overall length may range from 9 to 12 feet. For general applications, the overall length may range from 12 to 14 feet. For fast or long haul applications, the overall length may range from 14 to 21 feet in an embodiment. The beam or width of the CWAB 10 may vary from the bow 12B to tail or rear 12A and have a maximum width of about 20 to 50 inches and about 30 to 36 inches in an embodiment. A user may kneel and use their arms to maneuver/propel the board or a paddle 212I. The paddle 212I may include a handle 212I, shaft 214I, and a blade 216I as shown in FIG. 3D.

The CWAB 10 may have a buoyant core covered by a structural shell on the top 12E and bottom 12F, such as a polyurethane or polystyrene foam core with a fiberglass shell (layers of fiberglass cloth and polyester or epoxy resin) in an embodiment. A CWAB 10 could also be formed of wood, veneer, carbon fiber, Kevlar, plastic, polymers, foam, fiberglass, epoxy, or a combination of these materials in an embodiment.

As also shown in FIGS. 1A and 1B, the CWAB 10 top 12E may include an internal rail 100 including a plurality or rail modules 100A, 100B. Configurable components 210A-C may be securely and removably couplable to one or more rail modules 100A, 100B in an embodiment. As shown in FIGS. 1A and 1C-1E, the coupled components 210A-C of the WABS 200 include a chair 210A, straps 210B, and a bottle or cup holder 210C. As shown in the figures, the WABS 200 may have several straps 210B securely and removably coupled to the CWAB 10 via an internal rail module 100A.

Figure 2A:
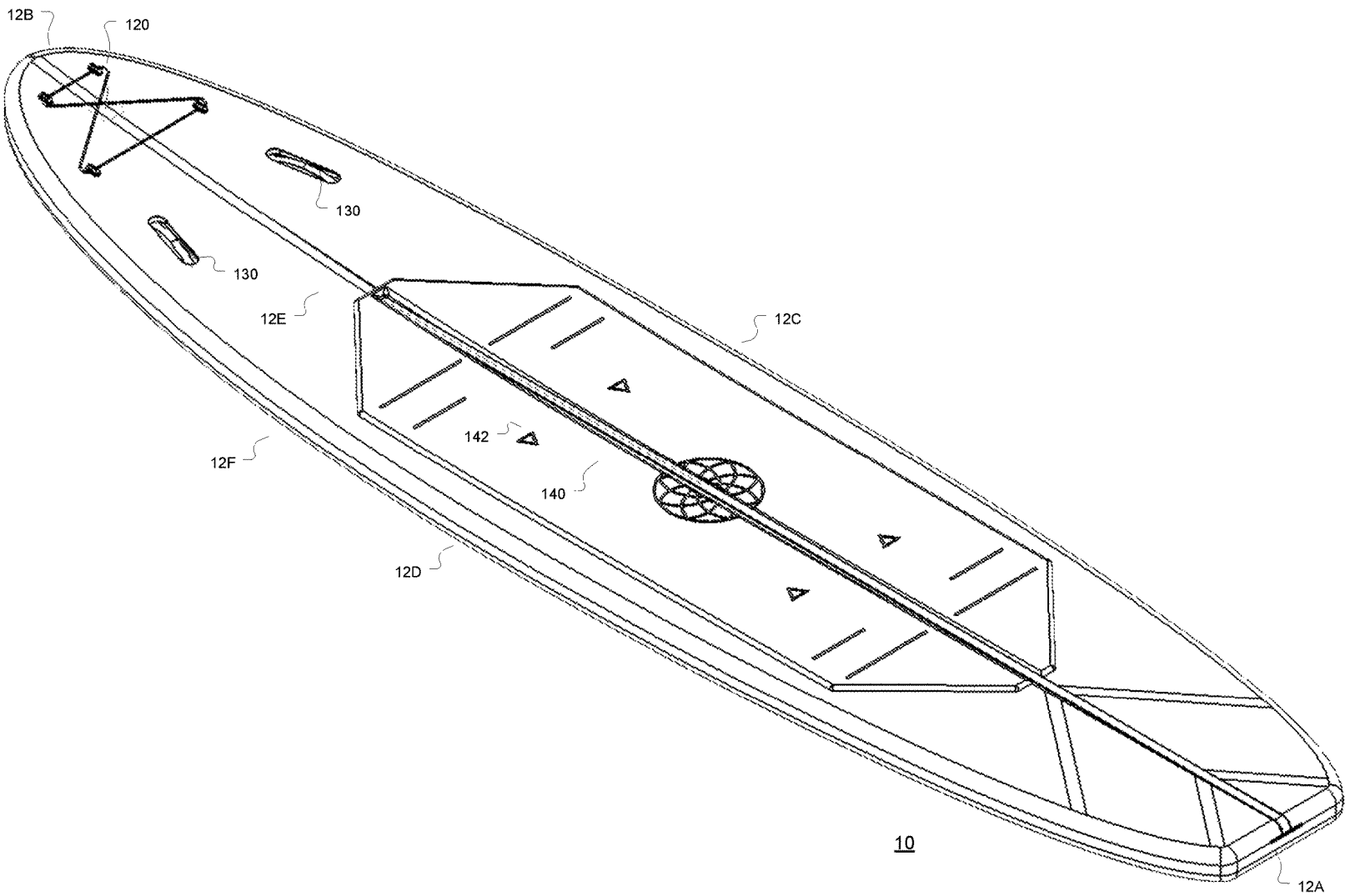
FIGS. 2A and 2B are configurable water activity board segments that form an exploded isometric view of the configurable water activity board configured with several components as shown in FIG. 1A according to various embodiments.
Figure 2B:
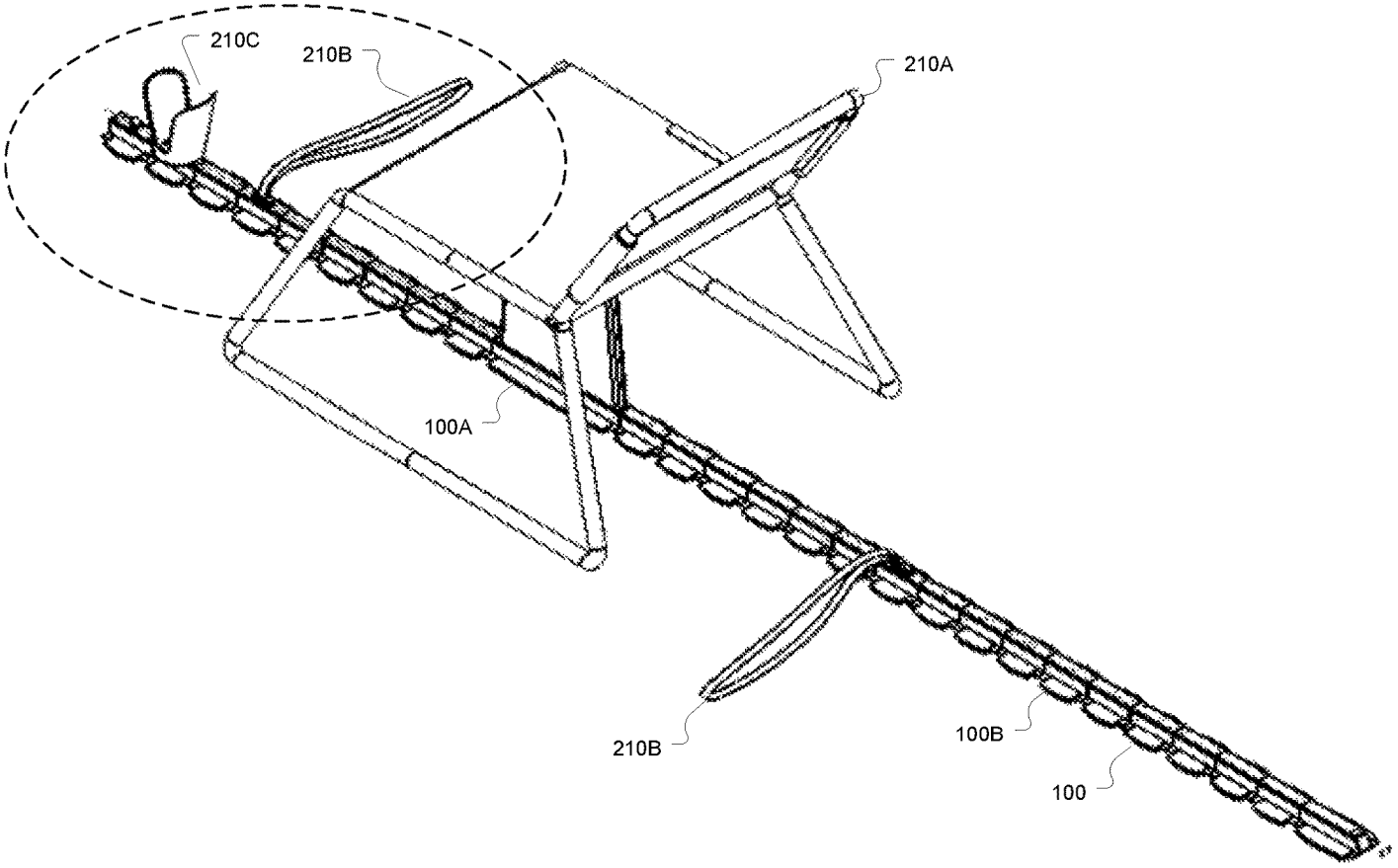

FIGS. 2A and 2B are an exploded isometric view of the WABS 200 including a configurable water activity board 10 configured with several components 210A, 210B, and 210C according to various embodiments. As shown in FIG. 2B, the internal rail 100 may include a plurality of rail modules 100A, 100B. Rail module 100A may be larger in length than the rail modules 100B and configured to accommodate larger components such as the chair 210A and stool 210F (FIG. 3A). Smaller components such as the straps 210B and the bottom/cup holder 210C may be couplable to the smaller rail module 100B. As shown in FIG. 2B, the internal rail 100 may include 26 rail modules 100B and one larger rail module 100A. In an embodiment, the rail modules 100A may be equal in length to about three of the smaller rail modules 100B. In an embodiment, the internal rail 100 may include 2 to 40 rail modules 100B and 1 to 15 larger rail modules 100A.

Figure 2C:
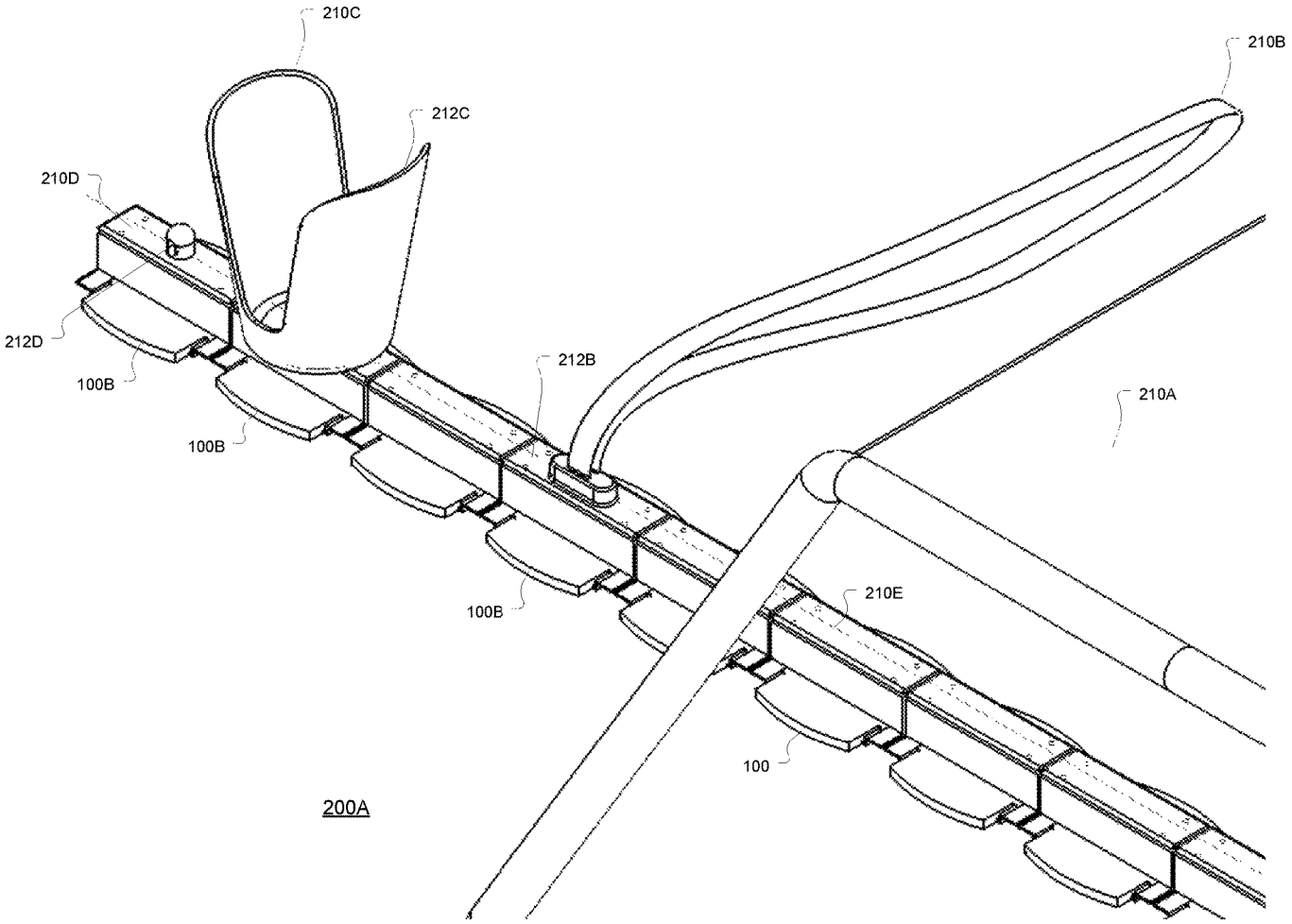
FIG. 2C is an enlarged view of the area AA shown in FIG. 2B according to various embodiments.

FIG. 2C is an enlarged view of the area AA shown in FIG. 2B according to various embodiments. As shown in FIG. 2C, the WABS 200 may include other components 210D and 210E. Component 210D includes an open fenestration 212D that may be used by a hook such a carbineer hook. Component 210E may function as an unused rail module 100B cover. The rail cover 210E may be sized to be flush with the CWAB deck or pad 140 to provide a smooth, level deck for a user. As also shown in FIG. 2C, the strap component 210B may include rail interface 212B that couples the strap end to a rail module 100B.

Figure 2D:
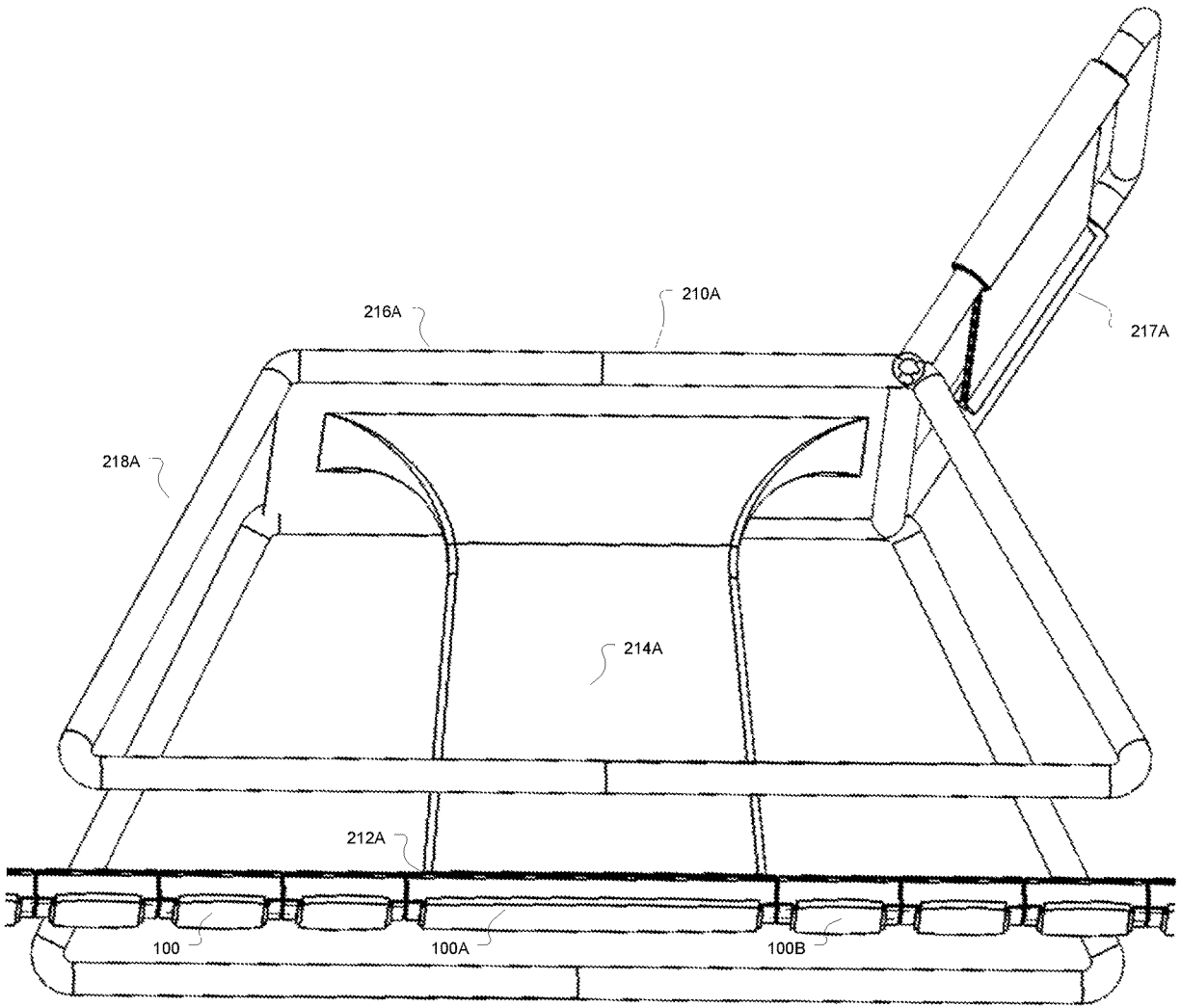
FIG. 2D is a left, partial enlarged view of FIG. 2B depicting a component coupled to a central, larger rail module according to various embodiments.

FIG. 2D is a left, partial enlarged view of FIG. 2B depicting the chair component 210A coupled to the central, larger rail module 100A according to various embodiments. As shown in FIG. 2D, the chair component 210A may include a chair rail interface 212A, a chair seat interface 214A, a chair seat 216A, a chair back 217A, and legs 218A. In an embodiment, the chair seat interface 214A may be an elastic or rigid member that couples the chair seat 216A to the larger rail module 100A via the chair rail interface 212A.

FIG. 3A is exploded isometric view of a segment a WABS 200B including configured with several components 210B, 210C, 210F, and 210G according to various embodiments. As shown in FIG. 3A, the component 210F may include a stool. The stool component 210F may include shaft 214F coupled to a rail interface 212F. The rail interface 212F may be couplable to the larger rail module 100A in an embodiment. The component 210G may include a shoulder strap for carrying a WABS 200. The straps ends may be pivotably coupled to two rail modules 100A via rail interfaces 212G.

Figure 3B:
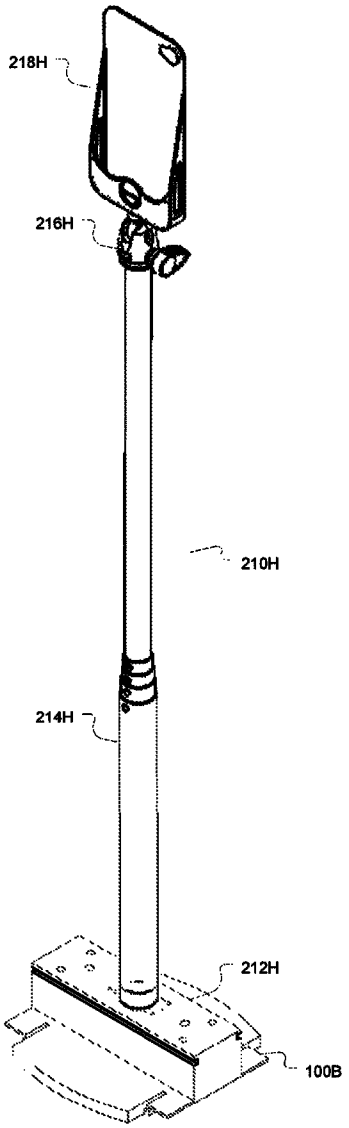
FIG. 3B is an isometric view of a component coupled to a rail module according to various embodiments.

FIG. 3B is an isometric view of a telescopic electronic device holder component 210H coupled to a rail module 100B according to various embodiments. As shown in FIG. 3B, the telescopic electronic device holder component 210H may include a rail interface 212H, telescopic section 214H, pivot 216H, and device holder 218H. The device holder 218H may be pivotably coupled to the telephonic section 214H via the adjustable pivot 216H. The device holder 218H may be configured and shaped to hold various electronic devices including, but not limited to, cameras, cellphones, tablets, GPS, and other portable electronic devices. The telescopic section 214 may have 2 to 15 sections and 5 sections in an embodiment and be coupled to the rail module 100B via a rail interface 212H.

Figure 3C:
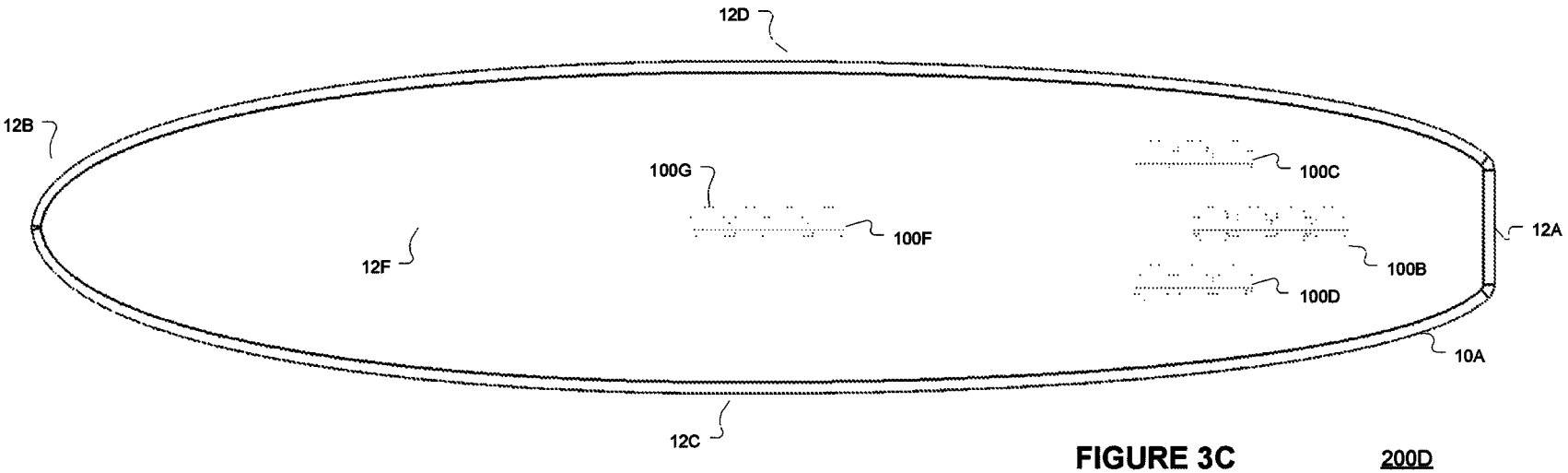
FIG. 3C is a bottom diagram of another configurable water activity board according to various embodiments.
Figure 3E:
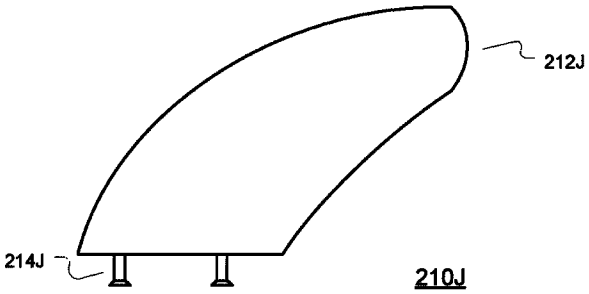
FIG. 3E is a side view of a skeg component that may be coupled to a bottom rail module according to various embodiments.

FIG. 3C is a bottom view 12F of another configurable water activity board (CWAB) 200D according to various embodiments. As shown in FIG. 3C, the CWAB may include one or more rail interfaces 100C-F that include rail modules 100G that are exposed to the CWAB bottom 12F. The rail modules 100G may be similar in size to the rail module 100B. The rail interface 100C-F may be employed to couple skeg components 210J as shown in FIG. 3E to the CWAB 200D. As shown in FIG. 3E, a skeg component 210J may include a fin 212J and one or more rail interface legs 214J, for further attachments and/or modules.

In an embodiment, other attachments may be coupled to the bottom 12F rail interface 100C-F modules 100B. Other attachments may include feet that enable a user to employ a CWAB 200D in a dry land application. Another attachment may enable a spherical element to be rotatably coupled to the bottom 12F rail interface 100C-F modules 100B where the spherical element may be a bosu ball and provide a dry land balancing application.

Figure 4A:
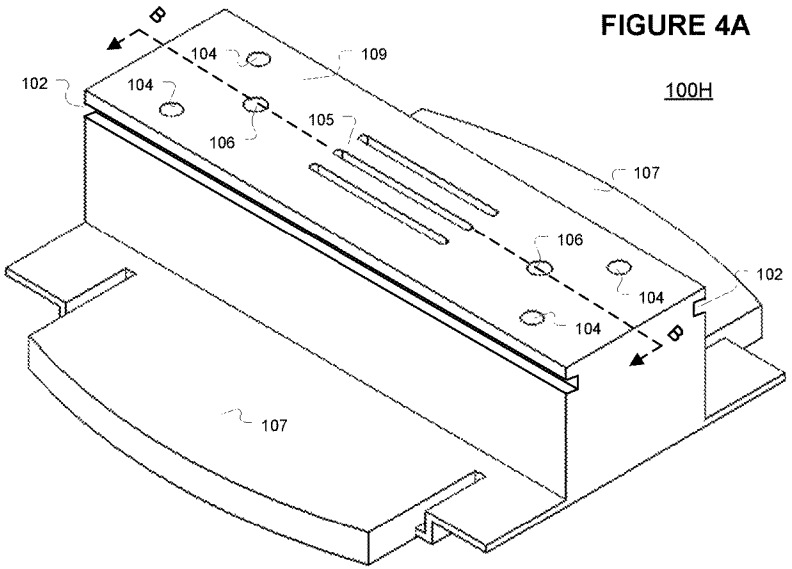
FIG. 4A is an isometric diagram of a rail module of a configurable water activity board according to various embodiments.
Figure 4C:
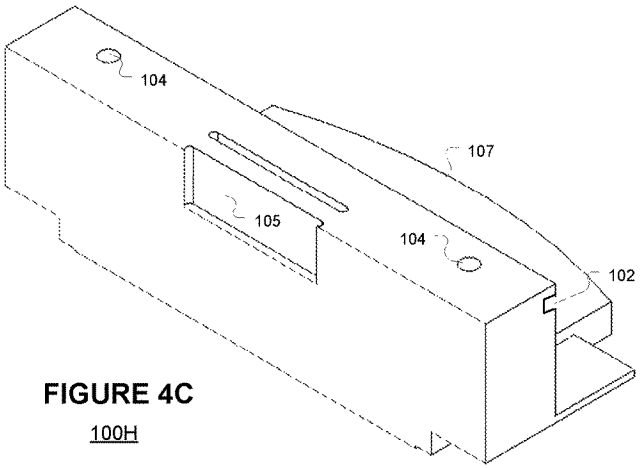
FIG. 4C is a cross-sectional view along line BB of the isometric diagram of a rail module shown in FIG. 4A according to various embodiments.
Figure 4B:
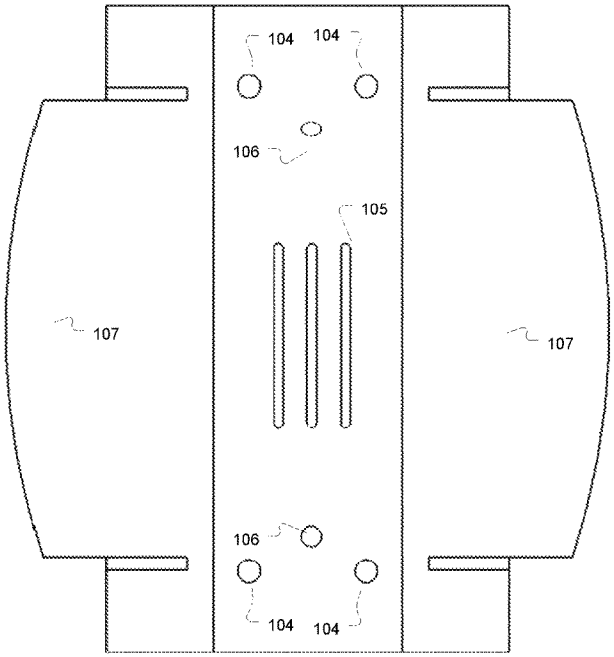
FIG. 4B is a top view diagram of the rail module shown in FIG. 4A according to various embodiments.

FIG. 4A is an isometric diagram, FIG. 4B is a top view diagram, and FIG. 4C is a cross-sectional view along line BB of a rail module 100H of a configurable water activity board 10 according to various embodiments. The rail module 100H may be employed as rail module 100A, 100B, or 100G in an embodiment. As shown in FIGS. 4A-4C, the rail module 100H may include rails 102 on its sides, fenestrations 104, 106, slits 105 in its top 109, and wings 107. As shown in FIG. 4C, the slit may have depth and length. The fenestrations 104, 106 may be a similar depth and may or may be threaded in an embodiment. As shown in FIGS. 4A-4C, the wings 107 extend horizontally and below the rail top 109. In an embodiment, a rail module 100H may inserted into the CWAB 10 core (foam in one embodiment) and then glassed in about the wings 107 leaving the top 109 exposed. As shown in these figures, a rail module 100H may also include a side rail 102. In an embodiment, components 210A-H may include complementary protrusions or rails to engage the fenestrations 104, 106 and side rails 102.

Figure 5A:
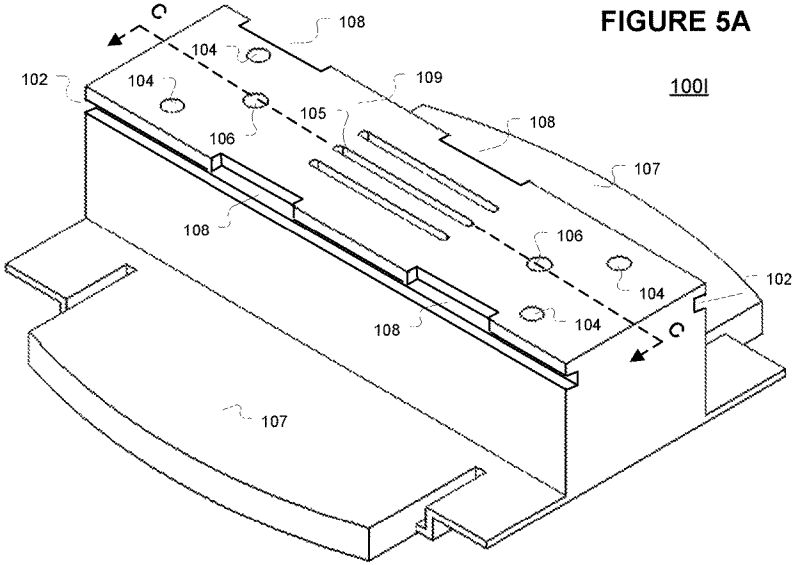
FIG. 5A is an isometric diagram of another rail module of a configurable water activity board according to various embodiments.
Figure 5C:
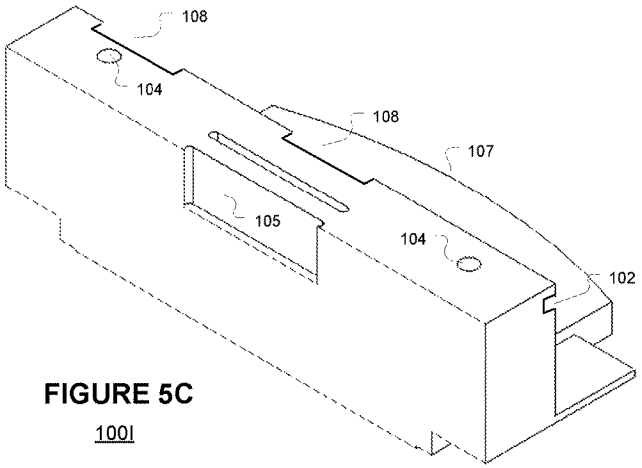
FIG. 5C is a cross-sectional view along line CC of the isometric diagram of a rail module shown in FIG. 5A according to various embodiments.
Figure 5B:
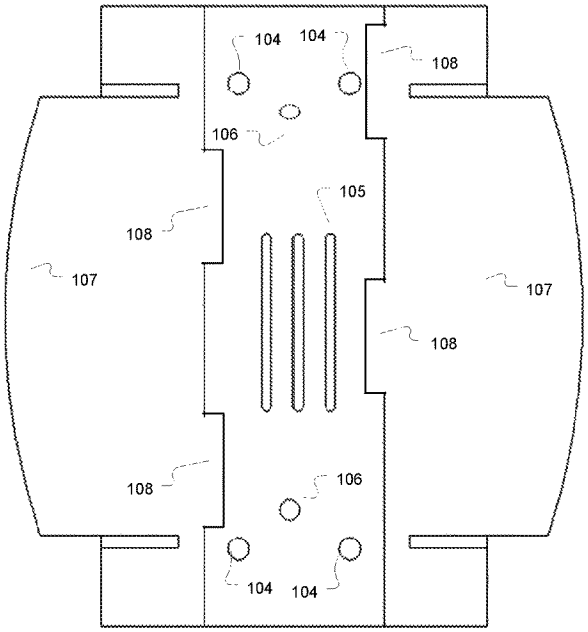
FIG. 5B is a top view diagram of the rail module shown in FIG. 5A according to various embodiments.

FIG. 5A is an isometric diagram, FIG. 5B is a top view diagram, and FIG. 5C is a cross-sectional view along line CC of a rail module 100I of a configurable water activity board 10 according to various embodiments. Rail module 100I is similar to rail module 100H but further includes one or more rail slots 108 in the side rails 102 that may enable complementary tabs of a component 210A-H in an embodiment to more easily engage a side rail 102.

Figure 6A:
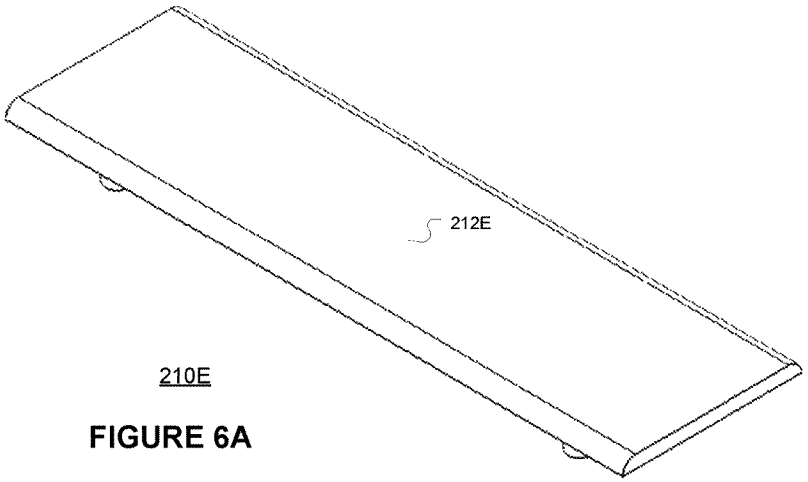
FIG. 6A is an isometric diagram of a rail module cover of a configurable water activity board according to various embodiments.
Figure 6C:
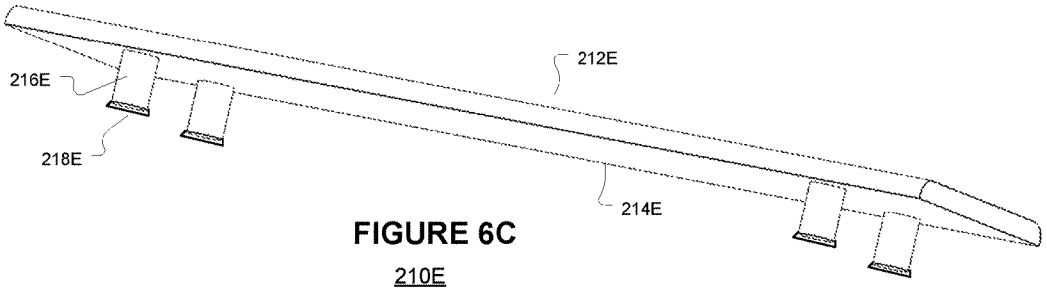
FIG. 6C is a rotated isometric diagram of the rail module cover shown in FIG. 6A according to various embodiments.
Figure 6B:
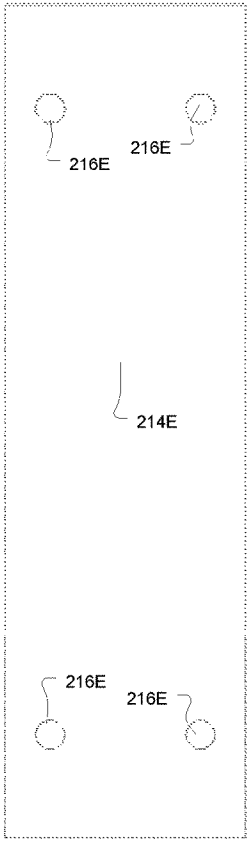
FIG. 6B is a top view diagram of the rail module cover shown in FIG. 6A according to various embodiments.

FIG. 6A is an isometric diagram, FIG. 6B is a top view diagram, and FIG. 6C is a rotated isometric diagram of a rail module cover 210E for a rail module 100A, 100B, 100G according to various embodiments. As shown in these figures, the cover component 210E may include a top 212E and bottom 214E. The bottom 214E may include two or more legs 216E with enlarged or flared ends 218E positioned and sized to securely and removably engage one or more rail module 100H, 100I fenestrations 104, 106.

The accompanying drawings that form a part hereof show, by way of illustration and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

What is claimed is:

1. A water activity board system, including:

a configurable water activity board including:

an elongated body including a front, rear, top and bottom formed about a core;

a plurality of rail modules forming an internal rail embedded in the core and at least partially exposed on the elongated body top; and a component including an interface that can be securely and removably coupled to one of the plurality of rail modules;

wherein the plurality of rail modules each have a length and one of the plurality rail modules has a length at least twice as long another the plurality of rail modules.

2. The water activity board system according to claim 1, wherein the plurality of rail modules forming the internal rail are only partially exposed on the elongated body top.

3. The water activity board system according to claim 2, the elongated body having a length from front to rear of about 12 to 18 feet.

4. The water activity board system according to claim 3, the elongated body having a width of about 2 to 4 feet.

5. The water activity board system according to claim 1, the elongated body including a compressible material on greater than 50% of the top's surface area.

6. The water activity board system according to claim 5, wherein the compressible material includes yoga position markings.

7. The water activity board system according to claim 1, including a plurality of components including an interface that be securely and removably coupled to one of the plurality of rail modules.

8. The water activity board system according to claim 1, including a plurality of components including an interface that can be securely and removably coupled to one of the plurality of rail modules wherein one of the plurality of the components includes an interface that can be securely and removably coupled to the one of the plurality rail modules having a length at least twice as long another the plurality of rail modules.

9. The water activity board system according to claim 1, including a plurality of components including an interface that can be securely and removably coupled to one of the plurality of rail modules wherein one of the plurality of the components is one of a chair and a stool and includes an interface that can be securely and removably coupled to the one of the plurality rail modules having a length at least twice as long another the plurality of rail modules.

10. The water activity board system according to claim 7, wherein the plurality of rail modules include a plurality of fenestrations in their top surface and the plurality of components include an interface that be securely and removably coupled to one of the plurality of rail modules via the plurality of fenestrations.

11. The water activity board system according to claim 7, wherein each of the plurality of rail modules includes a side wall rail along their length and the plurality of components include an interface that be securely and removably coupled to one of the plurality of rail modules via a side wall rail.

12. The water activity board system according to claim 7, wherein each of the plurality of rail modules includes a side wall rail along their length and a rail slot extending to the rail module top surface and the plurality of components include an interface that be securely and removably coupled to one of the plurality of rail modules via a side wall rail and top extending rail slot.

13. The water activity board system according to claim 5, wherein the compressible material includes nitrile rubber.

14. The water activity board system according to claim 13, further including a non-slip material covering the compressible material.

15. The water activity board system according to claim 1, wherein the plurality of rail modules form an elongated internal rail.

16. The water activity board system according to claim 15, wherein each of the plurality of rail modules has a length and are aligned end to end to form the internal rail.

17. The water activity board system according to claim 15, wherein the elongated body has a rigid shell formed over the foam core except over the partially exposed internal rail on the elongated body top.

18. The water activity board system according to claim 16, wherein the plurality of rail modules includes at least two rail modules.

19. The water activity board system according to claim 18, wherein the rigid shell is formed of fiberglass, wood, veneer, carbon fiber, Kevlar, plastic, polymers, foam, fiberglass, epoxy, or a combination of these materials.

* * * * *